US006915778B2

(12) United States Patent
Clemence et al.

(10) Patent No.: US 6,915,778 B2
(45) Date of Patent: Jul. 12, 2005

(54) THROTTLE MODULATION DEVICE FOR COMBUSTION ENGINE

(76) Inventors: Mark Clemence, P.O. Box 282, 220 Duke Street, Porcupine, Ontario (CA), P0N 1C0; Donald Elliott, Site 8, Comp 5, RR#1, Iroquois Falls, Ontario (CA), P0K 1G0

( * ) Notice: Subject to any disclaimer, the term of this patent is extended or adjusted under 35 U.S.C. 154(b) by 81 days.

(21) Appl. No.: 10/401,269

(22) Filed: Mar. 28, 2003

(65) Prior Publication Data

US 2004/0187845 A1 Sep. 30, 2004

(51) Int. Cl.[7] ..... F00D 41/00
(52) U.S. Cl. ..... 123/361; 123/399; 123/396
(58) Field of Search ..... 123/361, 399, 123/396

(56) References Cited

U.S. PATENT DOCUMENTS

| | | | | |
|---|---|---|---|---|
| 4,691,677 A | | 9/1987 | Hotate et al. | |
| 4,972,816 A | | 11/1990 | Mausner | |
| 5,046,943 A | * | 9/1991 | Muheim et al. | 431/62 |
| 5,078,109 A | * | 1/1992 | Yoshida et al. | 123/350 |
| 5,307,776 A | | 5/1994 | Unuvar et al. | |
| 5,823,164 A | | 10/1998 | Seki et al. | |
| 5,899,830 A | | 5/1999 | Tabata | |
| 6,073,610 A | * | 6/2000 | Matsumoto et al. | 123/396 |
| 6,098,594 A | | 8/2000 | Kowatari et al. | |
| 6,112,724 A | | 9/2000 | Kotwicki et al. | |
| 6,465,974 B2 | * | 10/2002 | Watanabe | 318/254 |

OTHER PUBLICATIONS

ISD–873 Open Power Unit 7.3–Liter V–8 Power Stroke, Ford Power Products Brochure (2 pages in all).
CompuShift Controller Specifications, published on the Internet at www.hgmelectronics.com/specifications (5 pages in all).
Throttle Commander documentation dated Oct. 2003 and Dec. 23, 2003 (10 pages in all).
Operating Instructions for the Auxiliary Idle Control Module, published by Powertrain Control Systems Division, Visteon Automotive Systems 1998 (pp. 1–24).

* cited by examiner

*Primary Examiner*—John T. Kwon

(57) ABSTRACT

The present invention relates generally to combustion engines, and more specifically, to an apparatus for controlling the power of combustion engines which have electrically-modulated throttle systems (also known as drive-by-wire throttle systems). There many applications in which it is desirable to modify the throttle control system of vehicles, for example, in limiting the power production of trucks operating in under ground mines. It is prohibitively expensive for vehicle manufactures to supply such modified vehicles, so a system must be provided and installed as an after market product. The invention provides a simple and inexpensive solution in the form of a voltage modifying device which can be installed inline, between the accelerator pedal sensor and the engine control unit. The voltage modifying device can be designed to limit the power of the engine, or alter the performance profile in a desired manner.

19 Claims, 7 Drawing Sheets

FIGURE 1 - PRIOR ART

THROTTLE MODULATION DEVICE FOR COMBUSTION ENGINE

The present invention relates generally to combustion engines, and more specifically, to an apparatus for controlling the power of combustion engines which have electrically-modulated throttle systems (also known as drive-by-wire throttle systems).

BACKGROUND OF THE INVENTION

For many years, combustion engines were controlled in a very simple way: the accelerator pedal was mechanically linked to a butterfly valve in a carburetor, which controlled the air/fuel flow into the engine. While this was an inexpensive and generally reliable approach, it was very inefficient and imprecise. Carbureted and diesel engines often ran at sub-optimal levels, consuming more fuel, producing poorer emissions, and generating fewer horsepower than they were designed to.

Today, carbureted and diesel engines have almost exclusively been replaced with electronically controlled, fuel-injected engines because of the improvements in fuel consumption, emission production and power generation. A simplified block diagram of such a control system is presented in FIG. 1. In this diagram, the engine control unit 12 (ECU), receives input signals from the accelerator pedal 14 and a variety of other sensors 16, and processes the data it receives to generate signals which control the engine's fuel injectors 18 and a variety of other actuators 20.

The ECU 12 itself, typically consists of a micro-controller or microcomputer which has a central processing unit (CPU), read only memory (ROM), random access memory (RAM) and other support logic, which are used to execute-a stored control program.

The accelerator pedal 14 is mechanically connected to an accelerator position sensor 22 for detecting the position of the accelerator pedal 14. Thus, the position of the accelerator pedal 14 is converted to an electrical signal which is transmitted to the ECU 12. Note that the accelerator pedal 14 is normally biased upwards by a spring.

The nature of the sensors 16 may vary widely with the vehicle make, model and year. In general though, these sensors 16 may include manifold absolute pressure, mass air flow, engine speed, manifold charge temperature, exhaust gas recirculation flow, exhaust fuel/air ratio, coolant temperature sensor, vehicle speed, oxygen and other sensors.

With this data, the ECU 12 can perform calculations to determine the optional ignition and fuel conditions. The outputs are sent to the engine via the fuel injectors 18 and the other actuators 20. The group of actuators 20 may include, for example, various warning lights for the driver, exhaust gas recirculation valves and ignition coils.

Now, there are a number of scenarios in which end users may wish to modify this complex control system. In mining applications, for example, diesel trucks may be used underground. If the horsepower (hp) that a truck is producing is sufficiently low, then it can operate freely. However, if the power production of the truck is too high, workers must stop working in the area so they can avoid the truck's emissions (as well, air consumption is directly related to horsepower). Thus, there is a demand for a power modifying feature in trucks and other combustion engine vehicles.

Other applications for such a power modifying feature might include a traction control option for a truck or sportslutility vehicle (SUV), or a power limiter for a tour vehicle or float in a parade.

While technologically, vehicles could be manufactured with a modifiable throttle control system, there is not enough demand to justify the extraordinary expense automobile and truck manufacturers would face in providing this as an option. The cost of altering their assembly lines, parts supply and other manufacturing processes would be enormous and at the present, the manufacturers cannot justify these costs. Thus, any such system would have to be provided as an after-market option.

In many cases, the performance of the engine can be altered by replacing a pre-programmed integrated circuit in the ECU 12. However, programming a new integrated circuit is not straightforward as the operation of the ECU 12 is completely proprietary and very complex. Any mistakes could easily damage the engine or cause the engine emissions to fall outside of regulatory guidelines. As well, many different integrated circuits would have to be programmed to maintain a fleet of vehicles as the programming requirements generally vary with the make, model, year, transmission, engine and other specifications of the vehicles. The use of pre-programmed integrated circuits is therefore an expensive and impractical solution to the problem.

Speed limiters are known in the engine industry and are often, for example, used to prevent diesel generators from damaging themselves by rotating too quickly. Such overspeed preventors typically consist of an RPM sensor (rotations per minute sensor) and control circuit which advises an alarm condition and cuts off the ignition and/or fuel to the engine. These systems are complex, relatively expensive, and the installation of such a system as an after-market item would also be complicated and expensive. More important, such systems do not assist in limiting the power, but merely shut the engine off when a limit is exceeded. It would be very difficult to modify such a system to limit the power of the engine as such systems have no modulating ability, or interface with the engine system which would allow such modulation to take place.

There is therefore a need for a low cost power modifier for trucks and automobiles which can be sold and installed as an after-market product. This design must be provided with consideration for performance, reliability, purchase price, and the cost and difficulty of installation.

SUMMARY OF THE INVENTION

It is therefore an object of the invention to provide a novel method and apparatus for engine throttle control which obviates or mitigates at least one of the disadvantages of the prior art.

One aspect of the invention is broadly defined as an after-market device for a vehicle having a drive-by-wire throttle system, the drive-by-wire throttle system including an accelerator pedal sensor for generating a voltage signal, and an engine control unit for controlling the engine of the vehicle in response to the voltage signal; the after-market device comprising; means for receiving the voltage signal from the accelerator pedal sensor; means for modifying the voltage signal; and means for transmitting the modified voltage signal to the engine control unit.

Another aspect of the invention is defined as a method of modifying the performance of a vehicle having a drive-by-wire throttle system, the method comprising the steps of: disconnecting wiring between an accelerator pedal sensor and an engine control unit in the drive-by-wire throttle system; and inserting an after-market voltage modifier in-line between the accelerator pedal sensor and the engine control unit; the after-market voltage modifier including:

means for receiving a voltage signal from the accelerator pedal sensor; means for modifying the voltage signal; and means for transmitting the modified voltage signal to the engine control unit.

BRIEF DESCRIPTION OF THE DRAWINGS

These and other features of the invention will become more apparent from the following description in which reference is made to the appended drawings in which.

DESCRIPTION OF THE INVENTION

Figure 1:
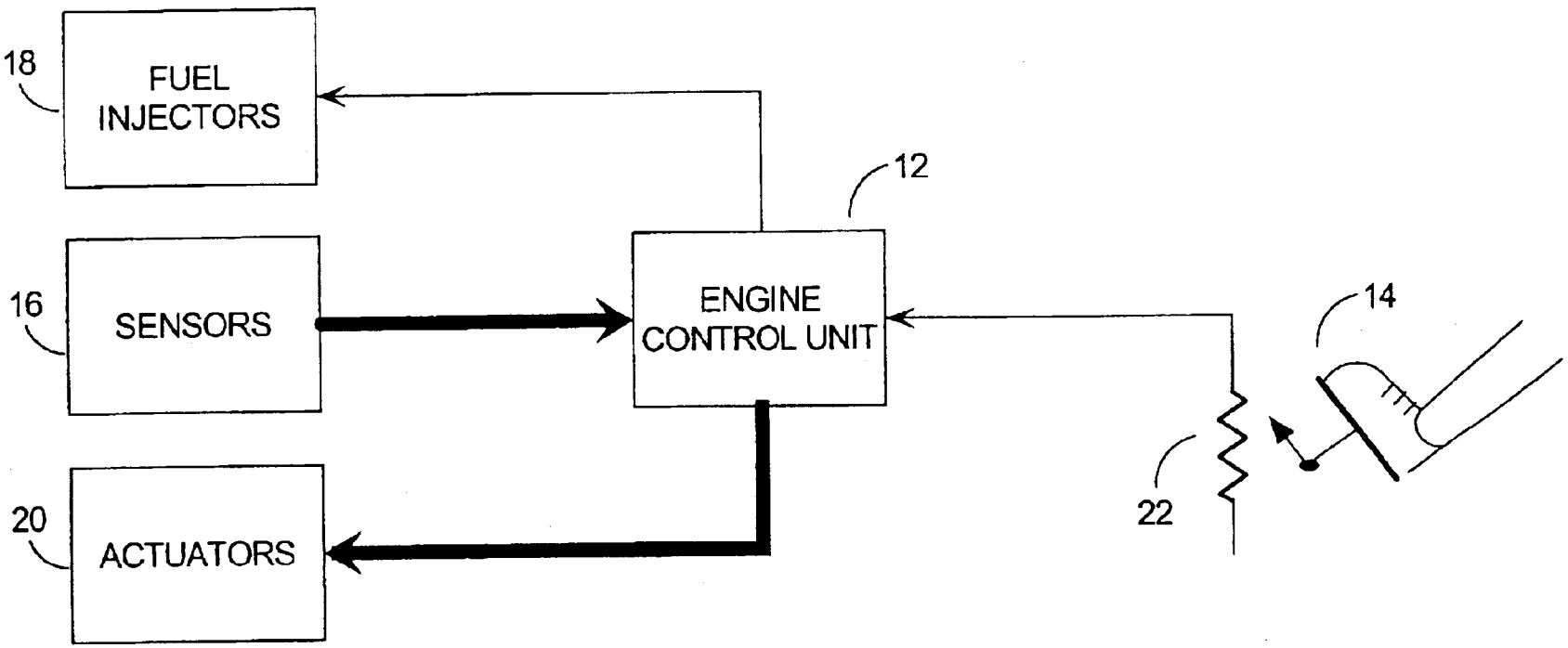
FIG. 1 presents a block diagram of a drive-by-wire throttle control system as known in the art.
Figure 2:
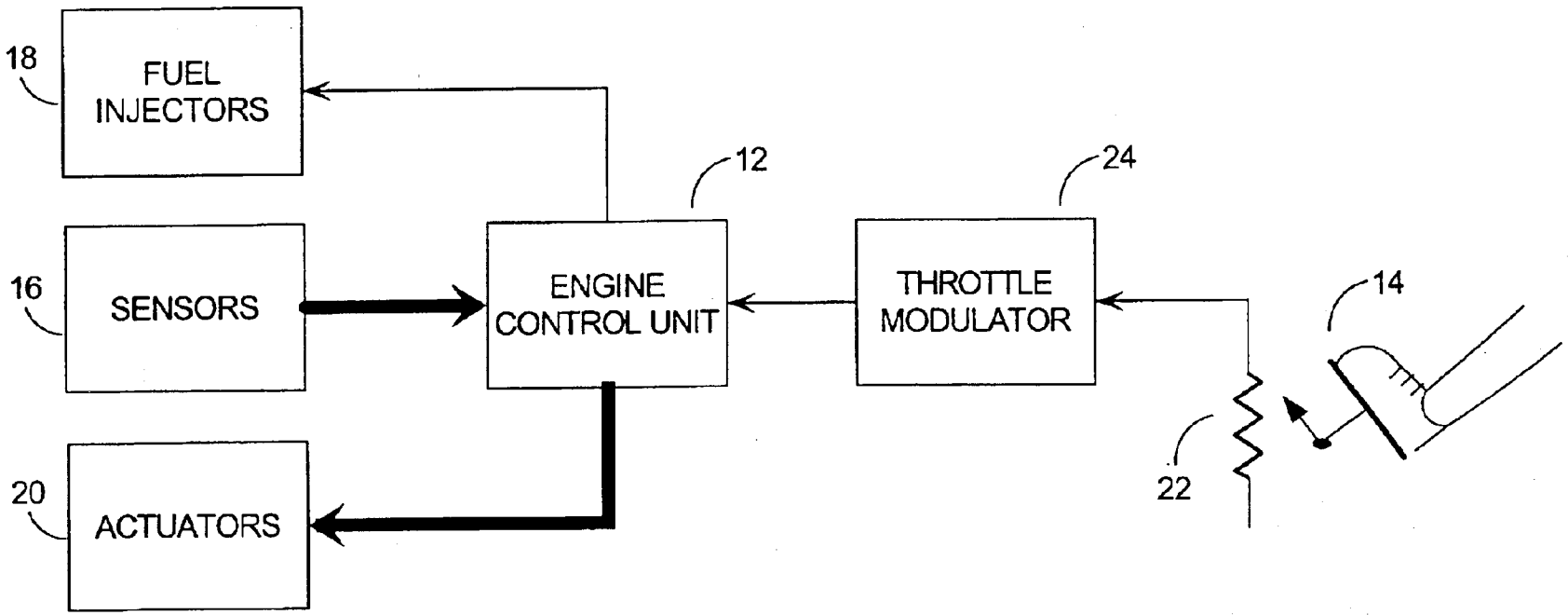
FIG. 2 presents a block diagram of a drive-by-wire throttle control system incorporating a throttle modulator in an embodiment of the invention.

An apparatus which addresses the objects outlined above, is presented in the block diagram in FIG. 2. This figure presents the throttle modulator 24 of the invention, in the context of the drive-by-wire engine control system known in the art and presented in FIG. 1. Simply put, the throttle modulator 24 is installed between the accelerator position sensor 22 and the ECU 12 so that it may modify the voltage signal being produced by the accelerator position sensor 22. As the ECU 12 responds to this voltage signal, the throttle modulator 24 has control over the power produced by the vehicle's engine.

Figure 3:
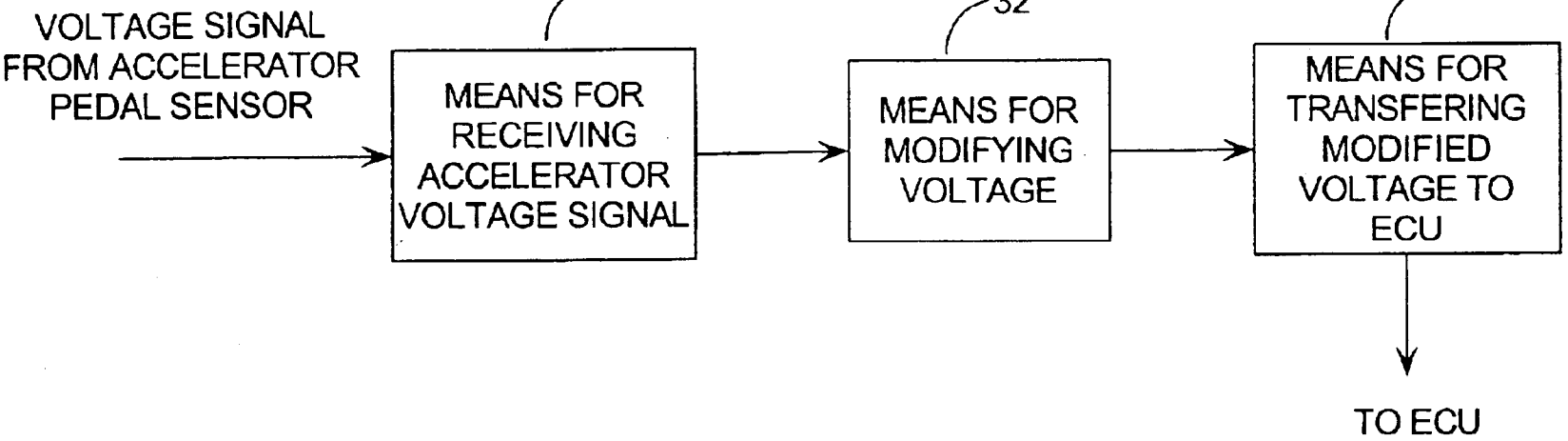
FIG. 3 presents a block diagram of a throttle modulator in a broad embodiment of the invention.

The throttle modulator 24 will typically be embodied as shown in the block diagram of FIG. 3. In this embodiment, the throttle modulator 24 consists of three main parts:

1. a first connector or similar means 30 for receiving the voltage signal from the accelerator position sensor 22;
2. an electrical circuit for modifying the voltage signal 32; and
3. a second connector or similar means 34 for transmitting the modified voltage signal to the engine control unit 12.

These three components can be embodied in a number of manners, several of which are described hereinafter. Other implementations would be dear from the teachings herein.

First, it should be noted that as vehicles are often exposed to harsh conditions such as high and low temperatures, humid or damp conditions, vibration and physical shock, the entire device and each of its components (i.e. first and second connectors 30, 34, as well as the electrical circuit for modifying the voltage signal 32) should preferably be fabricated with a durable endosure and sealed, or filled with a compound to resist corrosion such as a silicon dielectric. In many applications, the device should also be installed behind the dashboard of the vehicle to avoid damage or tampering. The electrical circuit for modifying the voltage signal 32 may take many forms, and will be determined by the nature of the throttle modifications required.

The performance curves for vehicles, their engines and ECUs 12 are generally available, so it is straightforward to design the electrical circuit 32 to effect the necessary modifications. In the description of the preferred embodiments which follow, reference is made to the Ford F250 diesel system. In this system, there is an almost linear relationship between the voltage produced by the accelerator position sensor 22 and the resulting power produced by the engine. Thus, the power can be reduced by employing a suitable voltage divider. Alternatively, the response profile can be changed from linear to non-linear by means of a simple semi-conductor circuit. The design of such circuits would be within the ability of one skilled in the art from the teachings herein.

Figure 4A:
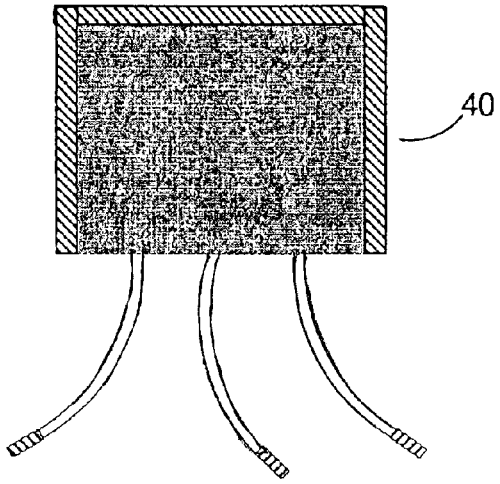
FIG. 4A presents an embodiment of the invention for hard-wired installation.

The first and second connectors 30, 34 may be effected in a number of manners as known in the art, including soldered connections or mechanical connections using (twist-on wire connectors such as) Marrette™ connectors, for example. FIG. 4A presents an exemplary throttle modulator 24 for such an installation. The electrical circuit 32 itself is embodied in a monolithic and sealed enclosure 40, where the wiring required for external soldered or mechanical connections simply pass out this enclosure 40.

Figure 4B:
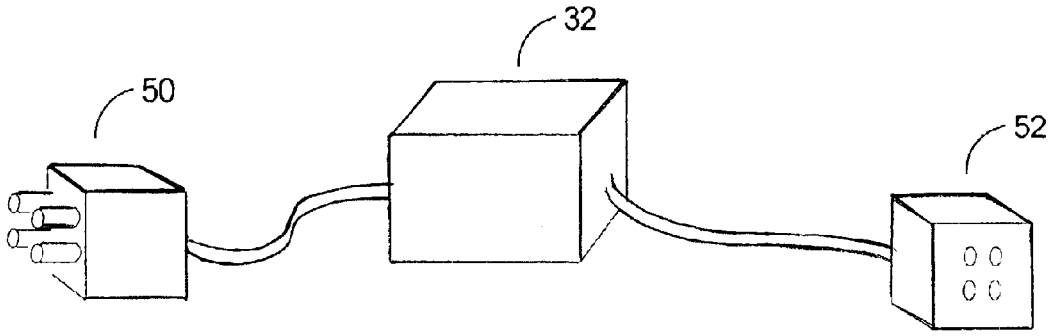
FIG. 4B presents an embodiment of the invention for plug-in installation.

In some vehicles, the accelerator position sensor 22 and the ECU 12 may be interconnected using a removable connector (such as a Molex™ connector), as part of a vehicle wiring harness. The throttle modulator 24 could be fabricated with complementary female and male connectors 50, 52, as presented in FIG. 4B, so that the throttle modulator 24 could easily be inserted in-line with the wiring harness. Alternatively, some existing wiring harnesses may allow a single connector to perform both roles.

Of course, the device of the invention is independent of the type of vehicle or the fuel system that it employs, therefore it could be used for propane, gasoline, carburetted, or fuel-injected vehicles as long as they have a "drive-by-wire" throttle system.

As noted in the Background, there are a number of applications in which it is desirable to have a vehicle which has a different throttle profile than that supplied by the vehicle manufacturer. Vehicle manufacturers are unable to provide such options as the cost is prohibitive, thus throttle modifications must be provided by after-market suppliers.

The only after-market throttle modification systems currently available have a number of serious pitfalls. For example, as noted above, the pre-programmed integrated circuit in the ECU 12 could be replaced with a new integrated circuit, however:

designing and programming the new integrated circuit is very difficult because of the complexity and the proprietary nature of the ECU 12;

errors could easily damage the engine or cause the engine emissions to fall outside of regulatory guidelines; as well many different integrated circuits would have to be produced to suit the varying makes, models, years, transmissions and engines in a given fleet of vehicles.

In contrast, the solution of the invention is very simple to design, and all of the design details (such as the voltage output of the accelerator position sensor 22) can easily be found. As long as the output voltage of the throttle modulator 24 is within the range allowable to the ECU 12, no damage can be caused to the vehicle, nor will it produce excessive emissions. While different design variations may be required for different vehicles in a fleet, it is possible to keep these design variations to a minimum by the use of variable resistors which can be tuned to each particular vehicle (this is described in greater detail hereinafter).

The system of the invention is also much more straightforward and reliable than the RPM sensor-based speed limiters known in the engine industry. It also offers far greater utility and flexibility than the simple alarms and cut-offs offered by speed limiters. The RPM sensor based system s also require the installation of multiple components under the hood of the vehicle. In contrast, the invention is very simple to install, only requiring the connection of several wires, or a couple of removable connectors. As the throttle modulator 24 may be installed under the dashboard of the vehicle, it is not necessary to pierce the firewall between the cabin and the engine.

Other advantages of the invention are identified hereinafter, with respect to particular embodiments of the invention that are described.

DETAILED DESCRIPTION OF PREFERRED EMBODIMENTS OF THE INVENTION

The primary application of the invention is expected to be In a mining environment. Typical health and safety regulations do allow diesel engine powered vehicles such as trucks, to be used underground, with some restrictions. If the horsepower (hp) that a truck is producing is sufficiently low, then it can operate freely. However, if the power production of the truck is too high, workers must stop working in the area so they can avoid the truck's emissions. Thus, there is a demand for a power modifying feature in trucks and other combustion engine vehicles.

Specifically, the intention was to provide a system that restricted the performance of a diesel engine for a given pickup truck. The design criteria that had to be met for the underground mining application for trucks were as follows:

1. reduction of horsepower from 240 hp to 120 hp;
2. prevention of damage to existing engine components by ensuring that the output voltage range of the throttle modulator 24 remained within acceptable parameters; and
3. maintenance of acceptable levels of air intake in Cubic Feet per Minute (CFM) in order to ensure a safe work environment for employees working at deep levels in the mine.

Figure 5:
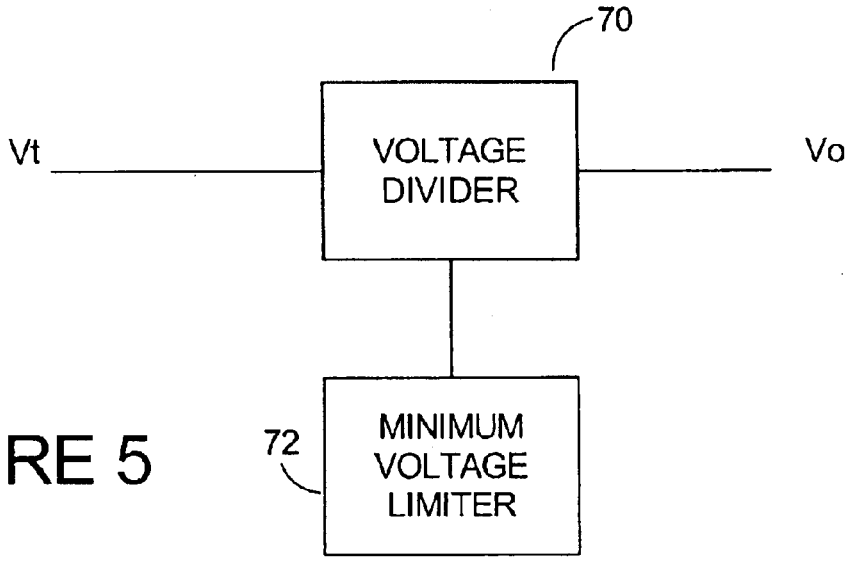
FIG. 5 presents a block diagram of a power regulating device with provision for circuit monitoring, in an embodiment of the invention.
Figure 6:
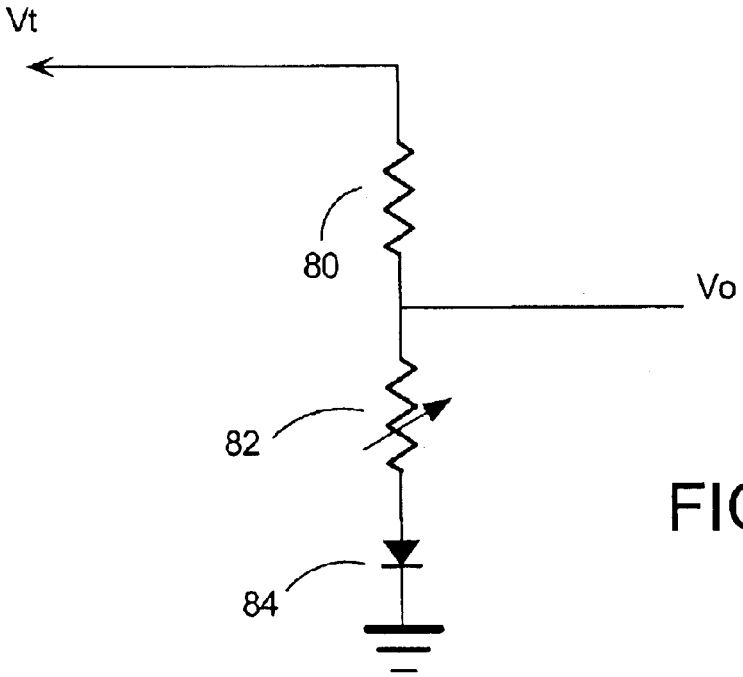
FIG. 6 presents an electrical schematic of a power regulating device in a preferred embodiment of the invention.

The circuit presented in the block diagram of FIG. 5 and the electrical schematic diagram of FIG. 6, was designed to limit engine horsepower in the drive-by-wire throttle system used by Ford F250 diesel trucks. The rationale for the design parameters are easily explained by reference to FIG. 7, which presents the relationship between the voltage sent to the ECU 12, and the position of the accelerator pedal 14.

Figure 7:
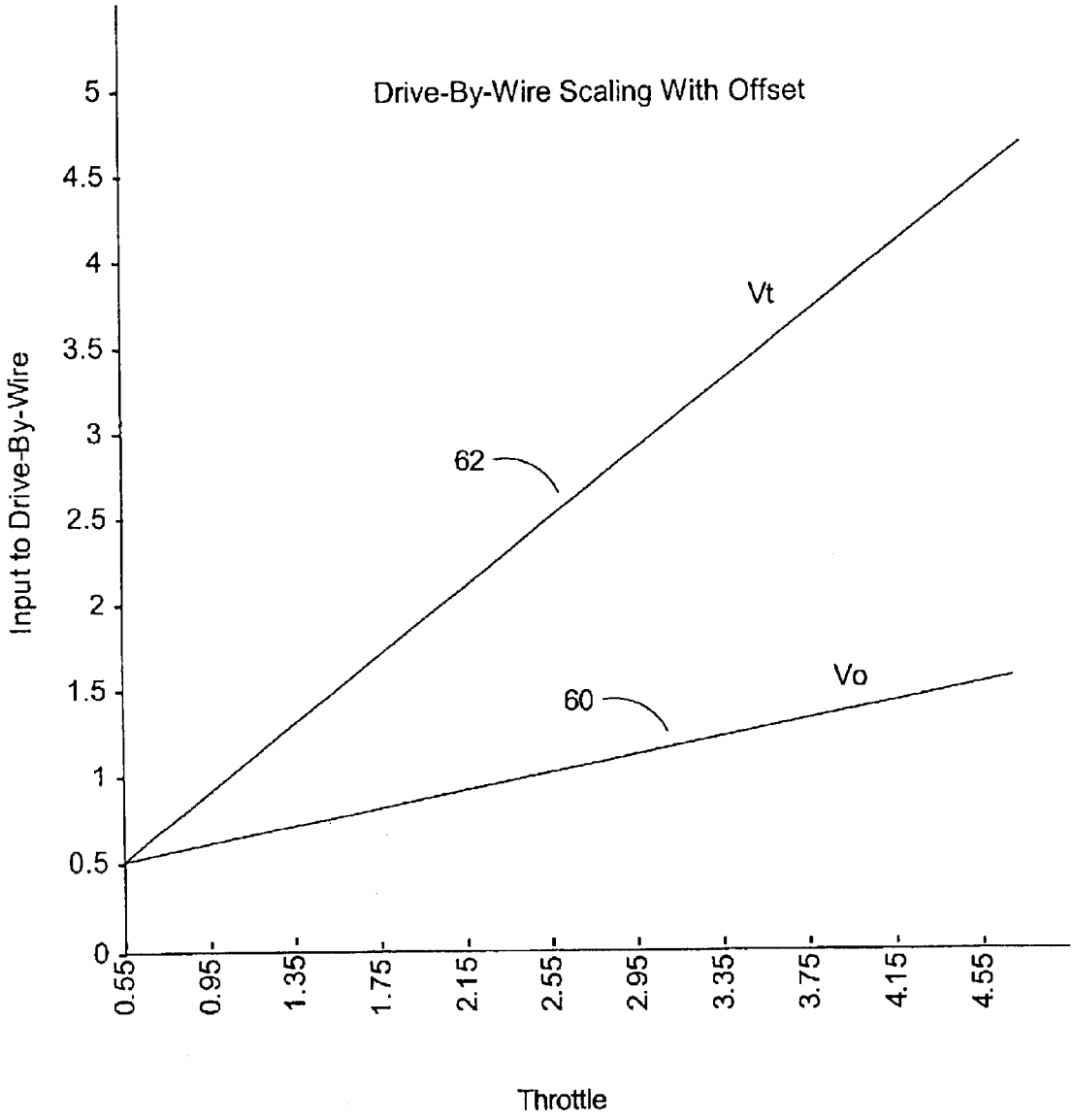
FIG. 7 presents a graph of input voltage to throttle output in an embodiment of the invention.

In Ford trucks, the accelerator pedal 14 is linked to a potentiometer, so the voltage that is sent to the ECU 12 varies with the position of the accelerator pedal 14 (represented by line 62 in FIG. 7). This potentiometer also has a "stop" so that a minimum signal of approximately 0.5 volts is always provided to the ECU 12. The ECU 12 uses this minimum signal as a diagnostic tool—so that it can confirm that the accelerator pedal signal circuit is closed, and has not shorted to ground. The resulting output signal is presented as line 60 in FIG. 7. Given the nature of the throttle signal and the requirement for a minimum output signal, it is straightforward to design a power limiting circuit. FIG. 5 presents a block diagram of such circuit, simply comprising a voltage divider 70 and minimum voltage limiter 72. The voltage divider 70 simply reduces the input voltage to an output that is determined by a division ratio for which it was designed. The minimum voltage limiter 72 ensures that the output voltage does not drop below the minimum voltage required for the ECU 12 diagnostics to verify that the circuit is operating correctly.

FIG. 6 presents an electrical schematic of an exemplary circuit which can perform the functionality described with respect to FIG. 5. The voltage divider 70, is performed using resistor 80 and a variable resistor 82. Having a variable resistor 82 in the circuit, allows the input to output ratio (i.e. the scaling factor) to be adjusted for different vehicles or certain conditions. Diode 84 performs the role of the minimum voltage limiter 72, ensuring that the output voltage never drops below approximately 0.5 volts.

The relationship between the input voltage Vt and output voltage Vo is easily calculated:

$$Vo=(VtR2+VdR1)\ (R1+R2)$$

where:

Vo is the output voltage;
Vt is the input voltage;
Vd is the voltage drop across the diode 84;
R1 is the resistance of resistor 80; and
R2 is the resistance of variable resistor 82.

In the specific application of the Ford diesel truck, the values for these components were therefore as follows:

R1=1 kohm, 14 watt
R2=2 kohm variable, ¼ watt
D1=1N4004

Thus, the passive circuit in FIG. 6 satisfies the minimum voltage conditions (approximately 0.5 V) required by the engine check routine and also produces scaled output over the entire throttle range.

Figure 8:
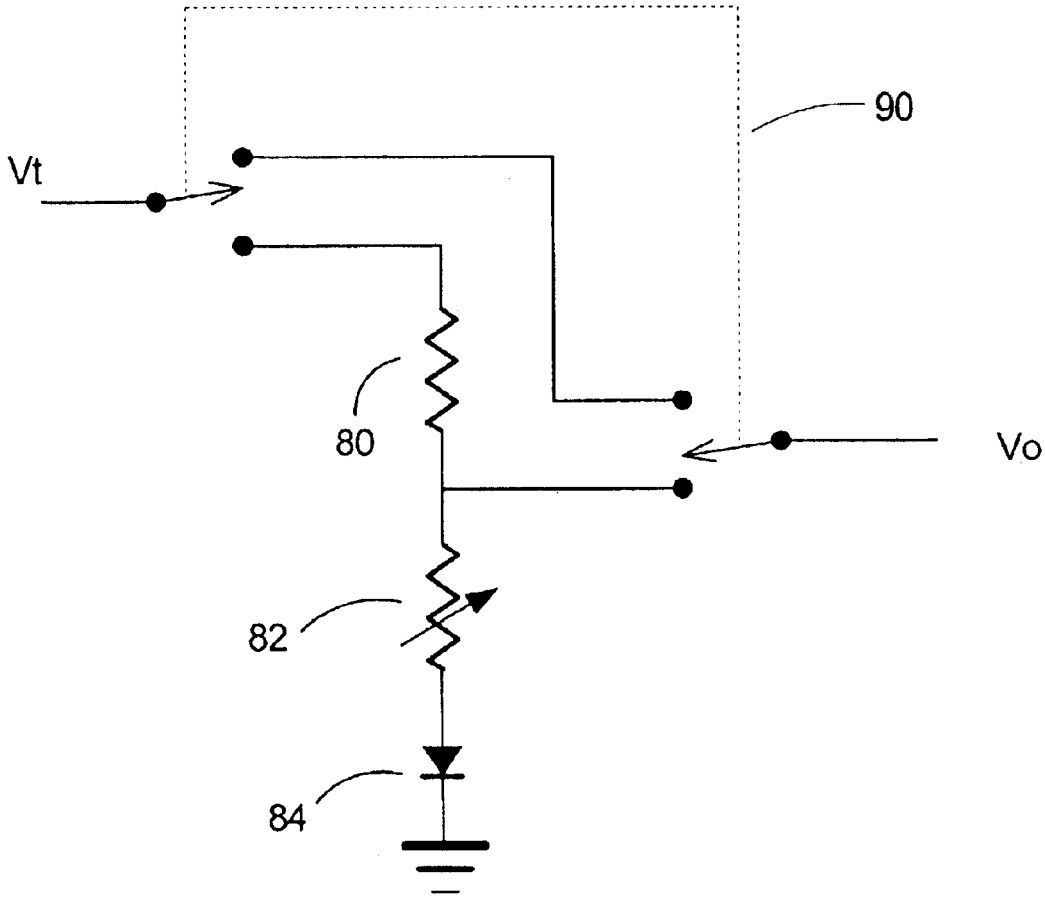
FIG. 8 presents an electrical schematic of a power regulating device having an override switch, in an embodiment of the invention.

The throttle modulator 24 could also be provided with an override switch 90 as shown in FIG. 8. This double-pole, double-throw (DPDT) switch allows the circuit of the invention to be overridden, so that the vehicle may be driven as originally designed. This override switch 90 could be panel mounted, or mounted in a hidden location.

For safety reasons, this override switch 90 will generally be interlocked with another device or operated by key only, to ensure that the low horsepower setting is used while the vehicle is underground. The override switch 90 could for example, be interlocked with a flashing light outside the vehicle, so that workers are aware when a vehicle is not operating under the power-restricted mode.

The device of the invention has been implemented using passive devices (resistors and diodes) because of their reliability and low cost. However, the invention could also be implemented using operational amplifiers, transistors, or other similar active devices. Active devices provide much greater functionality but at higher cost and complexity, and somewhat reduced reliability. As well, active devices introduce a safety hazard as the supply voltage could be impressed on Vo if an active component fails.

Note that the specifics of the voltage divider components may have to vary depending on the manufacturer and vehicle model.

Other Options:

The invention could be implemented in many different ways, including the following:

1. The relationship between the voltage in and out of the power limiter need not be linear. In some cases, for example, where a vehicle is generally driven at the same speed most of the time (say, for example, in a tour vehicle) it may be advantageous to have a response profile which is flatter in the area in which the vehicle is usually driven. That is, as the accelerator pedal is depressed the vehicle quickly accelerates; once the flat region is reached, the engine responds very little to any additional depression. Thus, the vehicle will not lurch around with small changes to the accelerator pedal position.

2. The system of the invention could also be used in applications where better sensitivity of the vehicle speed is necessary, such as in traction control systems. SUVs and four wheel drive vehicles, for example, may have a switch which introduces the speed limiter so that there is less likelihood of the tires spinning when the accelerator is depressed.

3. Feedback could easily be provided to the driver of the vehicle simply by installing signal lights or similar display devices on the dashboard of the vehicle. These signals could advise whether the throttle modulator 24 is in use or has been over-ridden, and whether it is in a certain mode. For example, if the throttle modulator 24 is designed to have certain stages or modes, the display could indicate which stage or mode the throttle modulator 24 is in.

While particular embodiments of the present invention have been shown and described, it is clear that changes and modifications may be made to such embodiments without departing from the true scope and spirit of the invention.

What is claimed is:

1. An after-market device for limiting a throttle control voltage signal of a vehicle having a drive-by-wire throttle system, said drive-by-wire throttle system including an accelerator pedal sensor for generating a voltage signal relative to the position of an accelerator pedal, and an engine control unit for controlling the engine of said vehicle in response to said voltage signal, said after-market device comprising:

means for receiving said voltage signal from said accelerator pedal sensor;

means for limiting said voltage signal; and means for transmitting said limited voltage signal to said engine control unit;

thereby limiting the power of said vehicle.

2. The device of claim 1, further comprising means for maintaining said voltage signal above a minimum level.

3. The device of claim 2, wherein said minimum level comprises a voltage level sufficient to indicate a proper operation status to the drive-by-wire throttle system.

4. The device of claim 2, wherein said means for maintaining said voltage signal, above a minimum level comprises a semiconductor junction.

5. The device of claim 4 wherein said means for maintaining said voltage signal above a minimum level comprises a diode.

6. The device of claim 1, wherein said means for limiting said voltage signal comprises means for scaling said voltage signal down.

7. The device of claim 6, wherein said means for scaling said voltage signal down comprises linear means for scaling said voltage signal down.

8. The device of claim 1 wherein said means for limiting comprises at least one operational amplifier.

9. The device of claim 1 wherein said means for limiting said voltage signal comprises a voltage divider.

10. The device-of claim 9 wherein said voltage divider comprises a resistor pair.

11. The device of claim 10 wherein at least one of said resistors comprises a variable resistor.

12. The device of claim 1, further comprising a sealed enclosure for containing said means for limiting and said means for maintaining, whereby said means for limiting and said means for maintaining are protected from environmental conditions.

13. The device of claim 1, further comprising a switch for overriding said means for limiting said voltage signal.

14. The device of claim 1, wherein all of said means are effected using passive components.

15. The device of claim 1, wherein said means for receiving and said means for transferring comprise electrical connectors.

16. The device of claim 15, wherein said electrical connectors are plug-in connectors.

17. An after-market device for limiting a throttle control voltage signal of an existing drive-by-wire throttle system, said device comprising:

means for restricting said throttle control voltage signal; and means for maintaining said throttle control voltage signal above a certain minimum level;

thereby limiting the power of said vehicle.

18. The device of claim 17 wherein said means for restricting and said means for maintaining comprise at least one operational amplifier.

19. A method of modifying the performance of a vehicle having a drive-by-wire throttle system, said method comprising the steps of:

disconnecting wiring between an accelerator pedal sensor and an engine control unit in said drive-by-wire throttle system; and inserting an after-market voltage limiter in-line between said accelerator pedal sensor and said engine control unit, said after-market voltage limiter including:

means for receiving a voltage signal from said accelerator pedal sensor;

means for limiting said voltage signal; and means for transmitting said limited voltage signal to said engine control unit.

* * * * *